United States Patent [19]

Lazzari

[11] 4,407,392

[45] Oct. 4, 1983

[54] SAFETY SCAFFOLD FOR METAL MELTING FURNACES

[75] Inventor: William B. Lazzari, LaGrange, Ill.

[73] Assignee: Western Electric Company, Inc., New York, N.Y.

[21] Appl. No.: 298,221

[22] Filed: Aug. 31, 1981

[51] Int. Cl.[3] ..... E04G 3/14

[52] U.S. Cl. ..... 182/128; 182/3; 182/187

[58] Field of Search ..... 182/128, 113, 222, 142, 182/3, 129, 36, 187; 52/220, 221

[56] References Cited

U.S. PATENT DOCUMENTS

| | | | |
|---|---|---|---|
| 606,500 | 6/1898 | Barry | 182/113 |
| 1,172,720 | 2/1916 | McGary | 182/36 |
| 1,899,162 | 2/1933 | Lackner . | |
| 1,971,294 | 8/1934 | Bunker | 182/3 |
| 2,336,432 | 12/1943 | Wilson | 182/113 |
| 2,478,004 | 10/1949 | Newell | 182/36 |
| 2,484,350 | 10/1949 | Lamb | 182/113 |
| 2,871,914 | 2/1959 | Timoney . | |
| 3,022,855 | 2/1962 | Lewis | 182/3 |
| 3,270,441 | 9/1966 | Hewes | 182/3 |
| 3,331,169 | 7/1967 | Cumming | 52/220 |
| 3,439,794 | 5/1969 | Park | 182/128 |
| 3,850,596 | 11/1974 | Fisher | 182/222 |
| 4,276,956 | 7/1981 | Mamula | 182/222 |
| 4,346,544 | 10/1982 | Larssen | 52/220 |

FOREIGN PATENT DOCUMENTS

| | | | |
|---|---|---|---|
| 371327 | 6/1973 | U.S.S.R. | 182/128 |

*Primary Examiner*—Reinaldo P. Machado
*Assistant Examiner*—Alvin Chin-Shue
*Attorney, Agent, or Firm*—R. P. Miller; K. R. Bergum

[57] ABSTRACT

A safety scaffold includes a platform (21) for supporting a workman while using jack hammer to remove encrustations (13) from a furnace wall (14). A pair of lanyards (29 and 31) are secured at first ends to a restraint worn by the workman, and at the opposite ends to a trolley (28) riding on a guide rail (27) so as to restrict movement of the workman toward an opening (23) in the platform. A duct system (24) is mounted beneath the platform (21) to exhaust fumes emanating from the furnace (11).

4 Claims, 5 Drawing Figures

FIG. 3
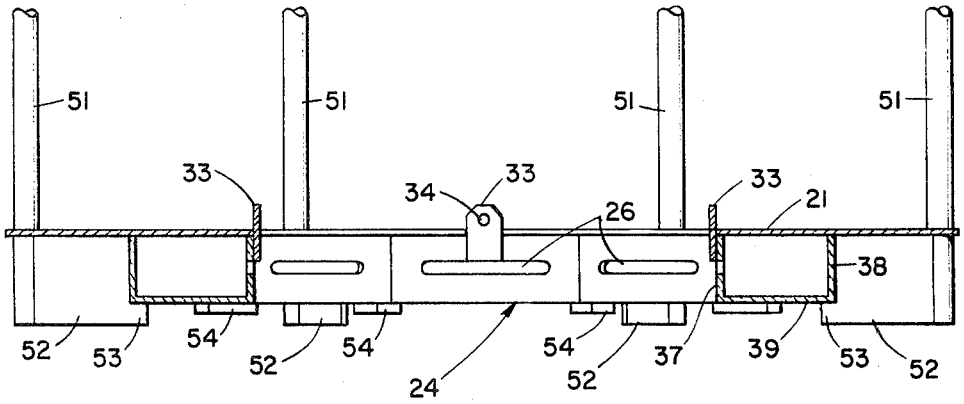
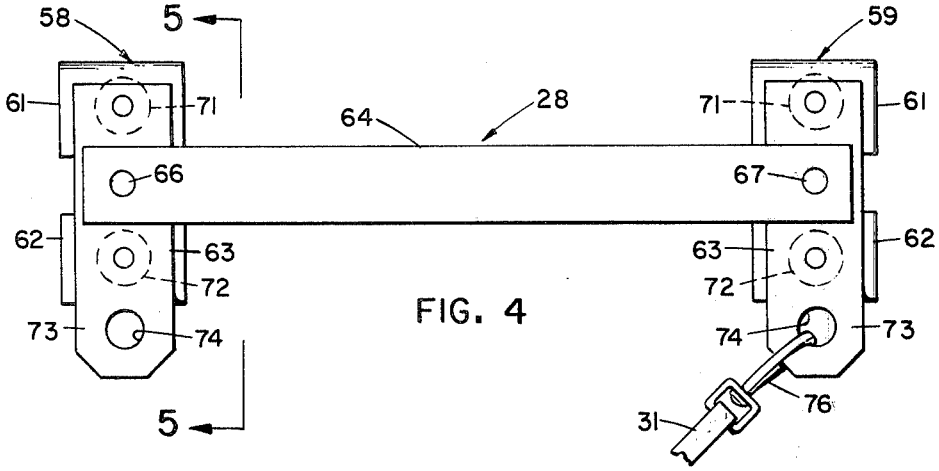
FIG. 4
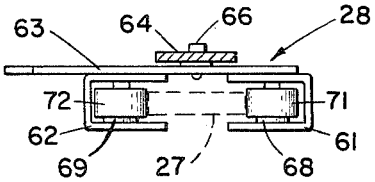
FIG. 5

SAFETY SCAFFOLD FOR METAL MELTING FURNACES

FIELD OF THE INVENTION

This invention relates to a safety scaffold for use with a metal melting furnace and, more particularly, to a safety scaffold for limiting movement of a workman on the scaffold and protecting the workman from noxious fumes emanating from the furnace.

BACKGROUND OF THE INVENTION

Certain furnaces used to melt or smelt various metals require periodic removal of encrustations of slag which accumulate about the inner circumference of the top portion of an inner wall of a furnace. This problem is particularly acute in the maintenance of large induction furnaces used to melt non-ferrous metals and alloys, such as copper alloys. In these instances, slag floats on the molten metal and is encrusted upon the adjacent inner furnace wall. The slag, which includes numbers of impurities, may also be the source of various noxious fumes.

Heretofore, upon the accumulation of slag encrustations it has been the practice to shut down the furnace and have a workman stand near the top of the furnace and use a jack hammer to knock off the slag encrustants.

SUMMARY OF THE INVENTION

This invention contemplates, among other things, a scaffold arrangement for use by a workman to remove slag encrustations from a furnace wall without shutting down the furnace, and which includes safety facilities for restricting movement of the workman while removing noxious fumes emanating from the furnace.

More particularly, a platform is provided with a central opening spanning a top opening in a vertical induction-type furnace. The platform is constructed with a diamond plate floor and is provided with a plurality of posts extending from the floor to support a trackway running completely about the platform. Mounted on the trackway is a trolley device which is secured to two rope lanyards that are clipped onto the workman to restrict movement toward the platform opening.

A duct system is secured to the underside of the platform and includes a number of venting openings directed toward any fumes emanating from the furnace. Vacuum pump means are connected to the duct system to withdraw the noxious fumes prior to reaching the workman.

The platform is connected to a hoist that permits the scaffold to be positioned and removed from the top of the furnace without disturbing the melt or requiring the shutdown of the furnace. When the scaffold is positioned about a furnace opening, a workman using the jack hammer may work about the platform opening and remove all the slag encrustations. Due to the trolley-lanyard arrangement, the workman's movement toward the platform opening is limited and, hence, obviating any possibility of accidental falling or tripping into the furnace opening. Further, due to the arrangement of the exhaust ducts beneath the platform, noxious fumes issuing from the furnace are withdrawn prior to reaching the workman.

BRIEF DESCRIPTION OF THE DRAWINGS

Other advantages and features of the invention will be apparent upon reading the following detailed description in conjunction with the drawing, wherein

FIG. 3 is a sectional view taken along line 3—3 of FIG. 2 illustrating a duct arrangement for exhausting fumes emanating from the furnace;

FIG. 4 is an enlarged top view of a trolley assembly that is attached to a safety harness worn by a workman and which functions to permit movement about the scaffold while restraining movement toward a central opening formed in the scaffold, and FIG. 5 is an end view of the trolley shown in FIG. 4 and illustrates the mounting of a pair of guide rollers.

DETAILED DESCRIPTION

Figure 1:
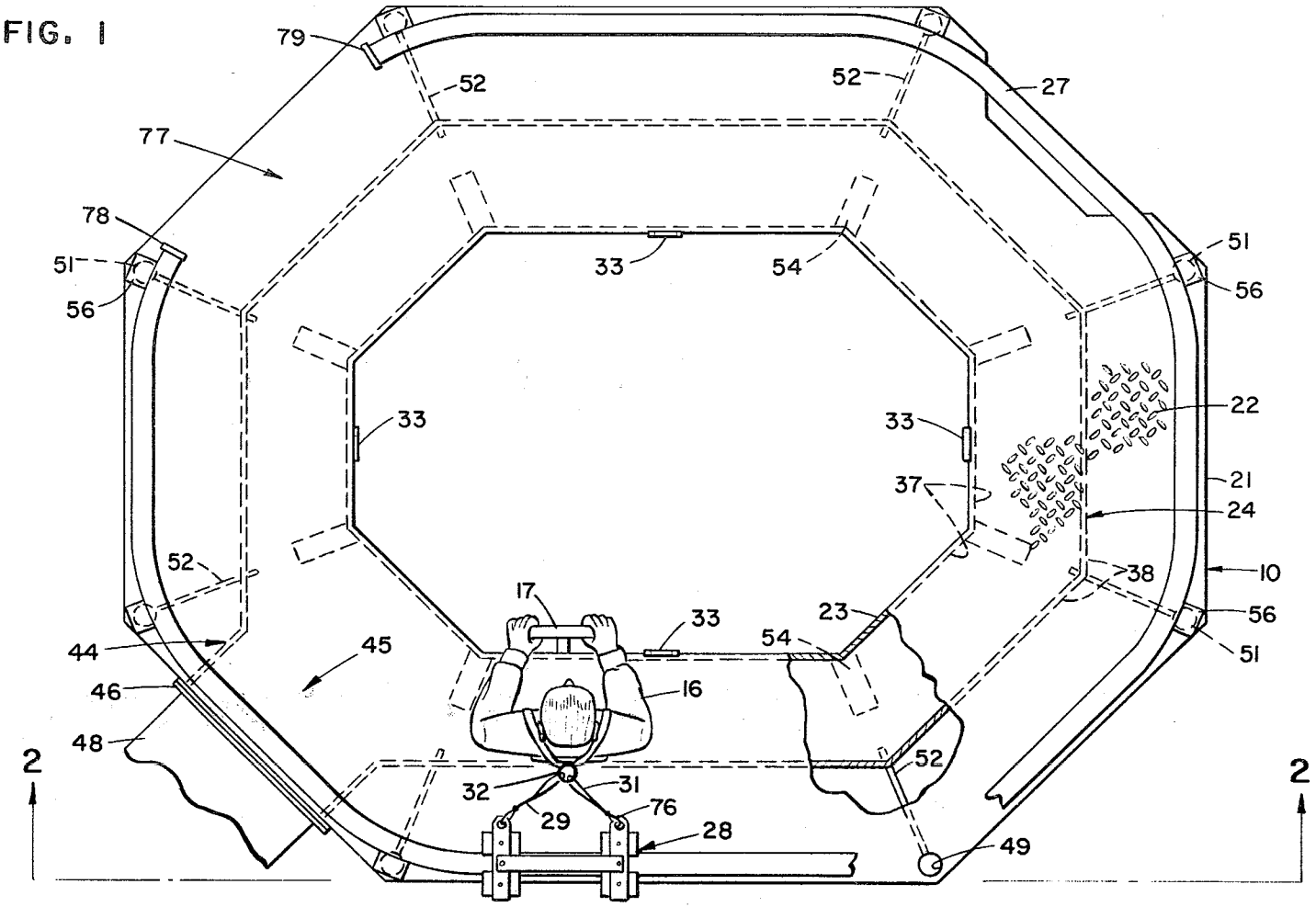
FIG. 1 is a top plan view of a safety scaffold incorporating the principles of the invention.
Figure 2:
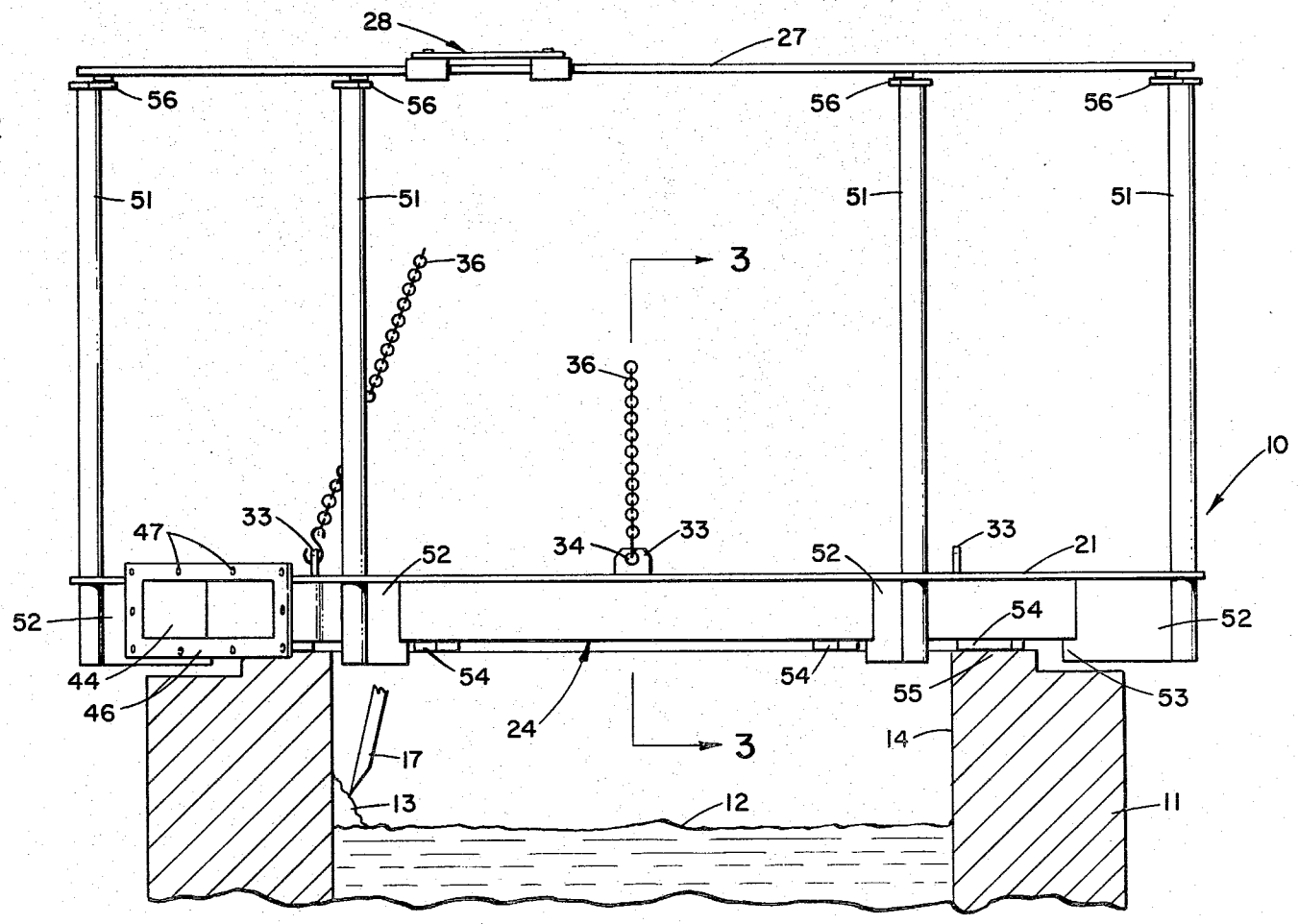
FIG. 2 is a side elevational view particularly illustrating the manner in which the scaffold is mounted on a furnace.

There is shown in FIGS. 1 and 2, a scaffold arrangement 10 that may be hoisted and transported by an overhead crane, not shown, or other industrial lift equipment to a site over a vertically extending mouth of a furnace 11 containing a charge of molten metal, e.g., copper alloy. The furnace 11 may be an induction type used to continuously cast alloys, such as brass or spinodals.

In use of furnaces of this type, a slag 12 is formed and floats on the molten metal surface. The slag may include many high temperature melting materials and, as a consequence, will not remain in the solution in the molten metal but rather deposits as encrustations 13 about a circular wall 14 of the furnace. With the scaffold arrangement 10 of the present invention positioned over and about the furnace opening, a workman 16 using a jack hammer 17 is able to knock the slag from the walls. The slag drops and floats on the molten metal and may be subsequently ladled off.

In general, the scaffold arrangement includes a metal platform 21 having a patterned surface of projecting lugs 22 to allow for drainage and to provide an interrupted surface to assure the footing of the workman walking about the platform. The platform 21 is provided with a central opening 23 corresponding generally in size to the opening in the furnace and which exposes the encrustations to the view of the workman.

Support for the platform 21 is provided by a duct system 24 constructed of metal plates, several of which are provided with inwardly directed openings 26 to allow fumes emanating from the furnace to be exhausted. Surrounding the platform is a safety rail 27 in the form of a trackway on which rides a trolley 28. A lanyard means in form of a pair of ropes 29 and 31 is attached to the trolley and the ropes are clipped to a safety harness 32 or heavy belt worn by the workman. The lanyard ropes are of a predetermined length so as to restrict movement of the workman to positions adjacent the platform opening 23.

Considering the structural details and referring to FIGS. 1, 2 and 3, there is shown a series of four short lift bars or lugs 33 each having a hole 34 to receive a hook attached to one of four hoisting chains or cables 36. The bars are positioned in notches formed in the platform 21 and are welded to four opposing plates of a series of eight inner plates 36 forming inner walls of the duct system 24. The duct system also includes outer plates 38 which along with the inner plates are welded to the flat underside of the platform 21. Closure for the duct system 24 is provided by a series of eight bottom plates 39 welded to the inner and outer plates. The inner plates 37 are constructed with the elongated slots 26 that open toward the fumes emanating from the furnace.

The duct system 24 also includes an exit section 44 formed of a rectangular array of plates which are welded at first ends about an opening 45 in the duct system 24, and at opposite, second ends to a frame 46 having holes 47 to receive bolts that are used to attach a flanged end of a conduit 48 that runs to an exhausting means, such as a pump or stack (not shown). It may be thus appreciated that various fumes emanating from the furnace are drawn through the openings 26 and passed through the duct system 24 to exit into the conduit 48.

As shown in FIG. 1, the platform is octagon in shape and is provided with holes 49 in the vicinity of each outer corner to receive an array of eight posts 51. A lower section of each post extending through the platform is welded to an outer edge of a plate 52 having a cleat section 53 underlying and supporting a bottom plate 39 of the duct system. Eight vertical plates 52 are shown as extending radially from the platform opening 23, and these plates are welded to the corners of the duct system and the underside of the platform. A series of eight steel blocks 54 are welded to the underside of the bottom plates 39 to underlie the inner corners of the platform 21. These blocks rest on a raised rim section 55 formed on the top of the furnace wall. In the situation where the top of the furnace wall is flat, the blocks will be of such size as to extend from the bottom of the platform the same distance as the plates 52.

The vertically extending posts 51 are welded at their tops to the underside of eight tab-like plates 56 which, in turn, are secured to the underside of the flat rail 27 that provides the trackway for the trolley 28. The rail is generally shaped in the form of an octagon with rounded corners to permit the free movement of the trolley 28.

Attention is directed to FIGS. 4 and 5 for a comprehensive understanding of the construction of the trolley 28 which consists of two riders generally designated by the reference numerals 58 and 59. Each rider includes a pair of U-shaped members 61 and 62, welded to a support element 63, which are coupled together by a link bar 64. The opposite ends of the link bar are pivotally mounted on a pair of shoulder bolts 66 and 67 screwed into threaded bores machined into the support elements 63. Mounted on bearing pins 68 and 69 located in the bights formed by the U-shaped members 61 and 62 are a pair of rollers 71 and 72 spaced apart distances sufficient to accommodate the guide rail 27. The support elements 63 have projecting ear sections 73 in which are formed apertures 74 to receive clips 76 (see FIG. 1) attached to the lanyards 29 and 31 which, in turn, are secured to the harness 32 worn by the workman.

In summary, the workman dressed in heat protective clothing may walk about the platform and use the jack hammer 17 to knock the slag encrustations 13 back into the molten metal 12. The workman may enter the platform through an entry 77 formed in the guide rail 27. He will attach the lanyards 29 and 31 to the trolley 28 which will restrict his movement toward the opening 23 in the platform. A pair of stop plates 78 and 79 are screw secured to the ends of the guide rail 27 to prevent the trolley from leaving the rail.

What is claimed is:

1. A scaffold for supporting a workman with respect to a top opening in a metal melting furnace, which comprises:

platform means of a size adapted to fit over and rest on the walls surrounding a furnace opening, said platform means having a central opening conforming to the opening in the furnace, and further including ducts extending around said platform opening having first vent openings facing the platform opening, and a second opening facing away from the platform opening;

means secured about said second opening for exhausting fumes from said duct means;

a plurality of spaced posts extending upwardly from the outer periphery of said platform means;

a track secured to the posts and running from a first to a last of said posts to leave an entry between said first and last posts;

a trolley mounted on and movable along the track; and lanyard means secured to the trolley and adapted to be attached to a workman on the platform means, said lanyard means being of such length as to restrict movement of the workman to positions adjacent to the platform opening.

2. A scaffold as defined in claim 1, which includes:

a plurality of lugs secured to the duct means about said platform opening and adapted to be connected to a number of hoist cables.

3. A scaffold for mounting about the periphery of an opening formed in a supporting structure, which comprises:

a platform having a centrally located opening conforming in size to the size of the opening in the structure;

a first conduit secured to the underside of the platform, said conduit having a series of slots facing said platform opening, and a second slot facing away from said platform opening;

a second conduit secured about said second opening and adapted to conduct fumes from the first conduit;

a series of plates secured to and spaced about the underside of the platform;

a plurality of posts individually secured to said plates and extending through said platform;

a rail secured to the ends of the posts;

a trolley mounted on said rail for movement therealong; and lanyards attached to said trolley and adapted to be secured to a restraint worn by a worker for limiting the worker's movement toward said platform opening.

4. A scaffold for use on a furnace having a vertically extending top opening, which comprises:

a duct shaped to extend about the furnace opening, said duct having first slots facing the furnace opening and a second slot facing away from the furnace opening;

a conduit secured to said duct about said second slot and adapted to conduct fumes from said duct;

a platform mounted on said duct and having a central opening shaped to encompass the furnace opening;

vertically mounted plates secured to the underside of the platform and spaced about the underside of the platform to extend radially from said platform opening;

posts secured to the outer edges of the plates and extending upwardly about the outer periphery of the platform;

a horizontal guide rail secured to the top of the posts and running from a first to a last of said posts to leave an entry opening between the first and last posts;

a trolley means having two sets of rollers spanning the guide rails;

lanyards attached to the trolley means and adapted to be attached to a workman on the platform to restrict the workman's movement toward the opening in said platform; and stop plates attached to the ends of the guide rails for confining movement of the trolley means to a path along said guide rail.

* * * * *